United States Patent [19]

Asik

[11] Patent Number: 4,478,201

[45] Date of Patent: Oct. 23, 1984

[54] ENHANCED SPARK ENERGY DISTRIBUTORLESS IGNITION SYSTEM (A)

[75] Inventor: Joseph R. Asik, Bloomfield Hills, Mich.

[73] Assignee: Ford Motor Company, Dearborn, Mich.

[21] Appl. No.: 583,063

[22] Filed: Feb. 23, 1984

Related U.S. Application Data

[62] Division of Ser. No. 450,932, Dec. 20, 1982.

[51] Int. Cl.[3] ..... F02P 3/04

[52] U.S. Cl. ..... 123/620; 123/621; 123/640; 123/643; 315/213

[58] Field of Search ..... 123/620, 621, 640, 643; 315/213, 222, 257

[56] References Cited

U.S. PATENT DOCUMENTS 4,136,301 1/1979 Shimojo et al. ..... 123/620

4,301,782 11/1981 Wainwright ..... 123/620

4,407,259 10/1983 Abo ..... 123/620

FOREIGN PATENT DOCUMENTS 1008198 5/1952 France ..... 123/640

682460 11/1952 United Kingdom ..... 123/620

*Primary Examiner*—Andrew M. Dolinar

*Attorney, Agent, or Firm*—Peter Abolins; Robert D. Sanborn

[57] ABSTRACT

A distributorless ignition system of an internal combustion engine has a supplementary spark energy module to increase spark energy. Two ignition coils each have secondary coils with split secondary center taps. Each of the primary windings is coupled to its own ignition module. The supplementary spark energy module is coupled to each of the split secondary center taps. A pair of spark plugs is coupled to one of the secondary windings and another pair of spark plugs is coupled to the other secondary winding.

2 Claims, 10 Drawing Figures

| | TIME 1 | 2 | 3 | 4 |
|---|---|---|---|---|
| CYL 1 | C | P | E | I |
| CYL 3 | I | C | P | E |
| CYL 4 | E | I | C | P |
| CYL 2 | P | E | I | C |

C – COMPRESSION
P – POWER
E – EXHAUST
I – INTAKE

ENHANCED SPARK ENERGY DISTRIBUTORLESS IGNITION SYSTEM (A)

This is a division of application Ser. No. 450,932, filed Dec. 20, 1982.

BACKGROUND OF THE INVENTION

1. Technical Field

This invention relates to ignition systems for internal combustion engines.

2. Prior Art

Distributorless ignition systems (DIS) are known and described in, for example, in "Ignition and Timing Systems", by K. L. Longstaff, Institution of Electrical Engineers Publication No. 181 (1979) entitled *Automotive Electronics* and in a Society of Automotive Engineers Technical Paper 780327 entitled "A Distributorless Ignition System—Solid State Ignition High Voltage Distribution with Low RFI Emissions" by J. R. Asik, D. F. Moyer, and W. G. Rado, 1978. The second article is devoted to a specific type of DIS utilizing a single ignition coil having two primary windings, a floating secondary winding, and four high voltage diodes to steer the ignition voltages to the proper spark plugs. Each high voltage terminal is connected to two spark plugs through a pair of high voltage diodes arranged in opposite polarity. This DIS is suitable for igniting a four cylinder engine. The first article referenced above is devoted to review of various types of ignition systems, including DIS. An alternate DIS design described for four cylinder application consists of two ignition coils, each having a single primary winding and a floating secondary winding. Each high voltage terminal is connected to a single spark plug and each ignition coil primary is alternately energized and quickly de-energized, producing opposite polarity ignition voltages at each coil terminal. As a result, pairs of spark plugs are alternately fired, with each firing pair occurring in a compression or exhaust stroke and thereby providing the proper ignition to the engine. For both types of DIS described, two-phased signals are required for each electronic module. Such signals can be generated by an electronic engine control.

U.S. Pat. No. 4,216,755 issued to Ordines discloses a distributorless ignition system for a four cylinder engine which includes a discharge module. The discharge module controls a Darlington pair which is in series with the primary windings of the ignition coil. Other related patents include U.S. Pat. Nos. 4,033,316 issued to Birchenough and 4,136,301 issued to Shimojo.

The prior art also teaches increasing the energy of the spark. When using very lean air/fuel mixtures it is known that increasing spark duration or intensity is desirable to improve combustion. For example, U.S. Pat. No. 4,191,912 issued to Gerry teaches a distributorless ignition system with a relatively high frequency alternating current power source to enable large quantities of energy to be fed to each igniter so that the fuel in the engine will be more completely combusted and exhaust contaminants reduced. There still remains a need for an improved apparatus for increasing spark energy in a distributorless ignition system.

SUMMARY OF THE INVENTION

This invention is directed to a distributorless ignition system which uses a supplementary spark energy (SSE) module to increase the ignition energy to and thus the ignitability of the igniter. The use of a split center tap double ended ignition coil permits the addition of the supplementary spark energy module to a distributorless ignition system resulting in increased spark energy and duration.

In accordance with an embodiment of this invention, a distributorless ignition system with increased spark energy includes a first and a second ignition coil, a first and second ignition module, and a supplementary spark energy module. The first ignition coil has a first primary winding and a first secondary winding including a first split secondary center tap. The second ignition coil has a second primary winding and a second secondary winding including a second split secondary center tap. The first ignition module is coupled to the first primary winding. The second ignition module is coupled to the second primary winding. The supplementary spark energy module is coupled to the first split secondary tap and the second split secondary tap. A first pair of spark plugs are coupled to the first secondary winding. A second pair of spark plugs are coupled to the second secondary winding.

DETAILED DESCRIPTION OF THE INVENTION

Figure 1:
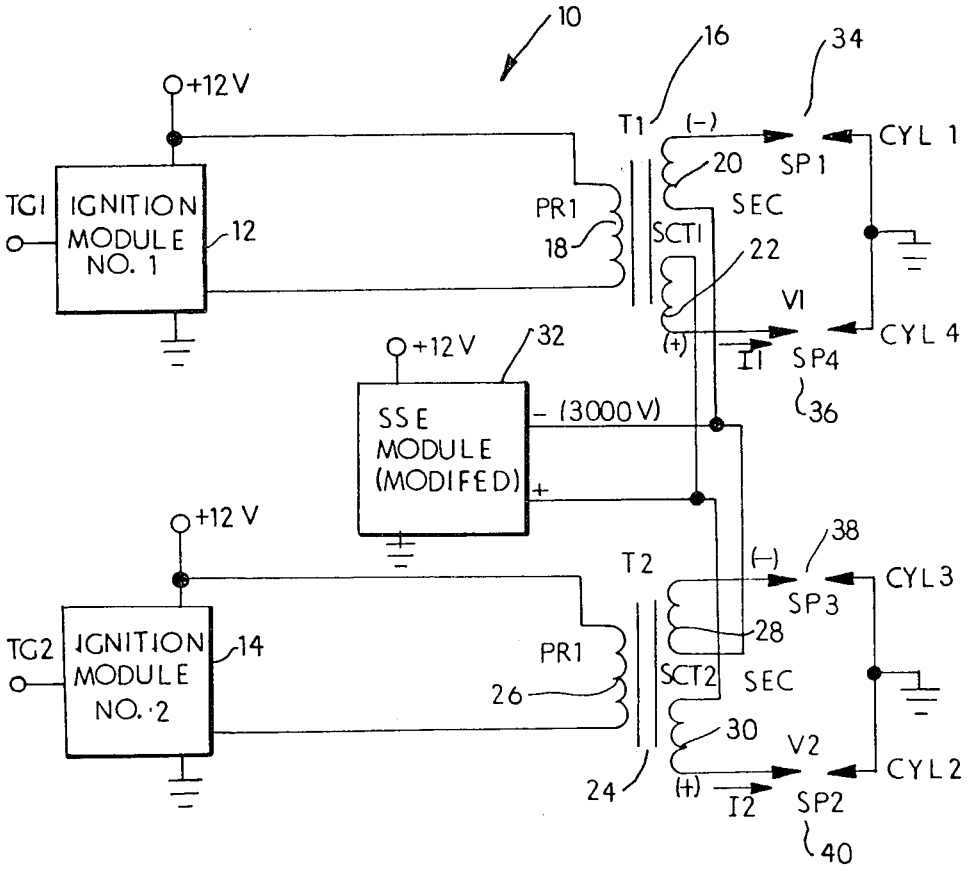
FIG. 1 is a schematic diagram of a distributorless ignition system in accordance with an embodiment of this invention including a supplementary spark energy module and two secondary windings each having a split secondary center tap.

Referring to FIG. 1, an ignition system 10 includes an ignition module 12 and an ignition module 14. Ignition modules 12 and 14 have triggering inputs TG1 and TG2, respectively. An ignition coil 16 has a primary 18 coupled to ignition module 12 and a pair of split secondary coils 20 and 22 with split center taps. Similarly, an ignition coil 24 has a primary 26 coupled to ignition module 14 and a pair of split secondary coils 28 and 30.

A supplementary spark energy module 32 has a negative output connected to the center taps of secondary coils 20 and 28 and a positive output connected to the center taps of secondary coils 22 and 30. A spark plug 34, associated with cylinder 1, is coupled to the outside tap of secondary coil 20. A spark plug 36, associated with cylinder 4, is coupled to the outside tap of secondary coil 22. A spark plug 38, associated with cylinder 3, is coupled to the outside tap of secondary coil 28. A spark plug 40, associated with cylinder 2, is coupled to the outside tap of secondary coil 30.

Figure 2:
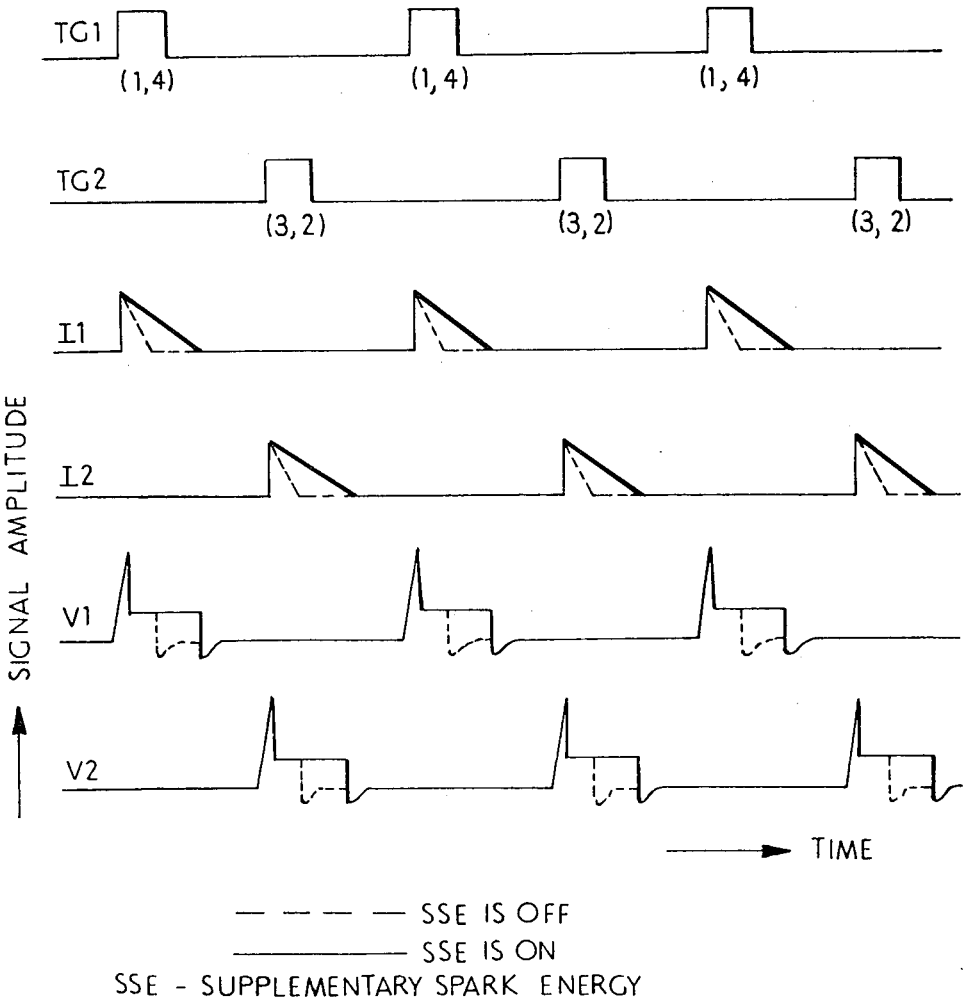
FIG. 2 is a plurality of waveforms at different locations of the circuit of FIG. 1.

Referring to FIG. 2, triggering input pulses are shown in lines marked TG1 and TG2. Lines I1 and I2 show the secondary current which comprises the spark. The dotted line segments of I1 and I2 indicate secondary current (spark energy) without the use of supplementary spark energy module 32. The solid line indicates the use of supplementary spark energy module 32 which provides a spark of longer duration. Lines marked V1 and V2 are the spark plug voltage comprising the spark and also include dotted line segments indicating supplementary spark energy module 32 being turned off and solid lines indicating supplementary spark energy module 32 being turned on. The spark energy can be calculated by multiplying current waveform I1 or I2 by voltage waveform V1 or V2, respectively, and integrating the results over time.

Figures 3, 4:
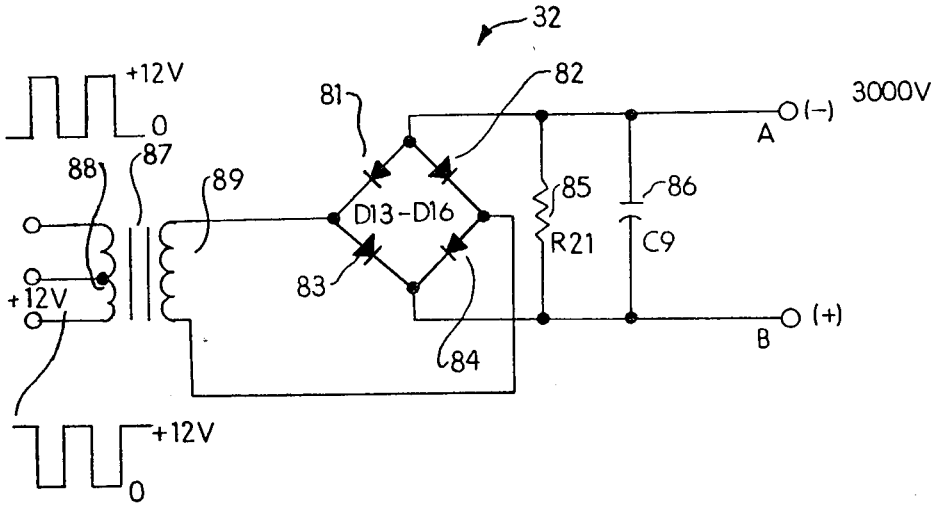
FIG. 3 shows the interrelationship of firing events including compression, power, exhaust and intake strokes in the four cylinder engine.
FIG. 4 is a schematic diagram of a supplementary spark energy module for use in an embodiment of this invention.

Referring to FIG. 3, the interrelationship of the firing events for the four cylinders is indicated. The letters therein correlate the engine cycle to a particular cylinder and time period by: C—Compression Stroke, P—Power Stroke, E—Exhaust Stroke, and I—Intake Stroke. During each time period, labeled 1, 2, 3, 4, one cylinder firing in the compression stroke is paired with another cylinder firing in the exhaust stroke. A pairing is indicated by the circled letters in the same time period column. Spark firing typically occurs in response to an ignition module pulse near the end of the compression (and exhaust) cycle at 20 degrees before top center of the piston position.

As is known, firing a spark plug during the exhaust stroke does not affect engine performance or emissions. However, spark plug firing during the intake stroke can have an undesirable effect on engine performance. Applying spark to a cylinder during its intake stroke may cause premature ignition resulting in backfire of the combustion mixture. Since in FIG. 1 supplemental spark energy is applied to all cylinders simultaneously, spark firing may occur even in the absence of an ignition module pulse. Spark firing during the power cycle is of little consequence. However, when supplemental spark energy from module 32 is applied to cylinder 3 during its intake cycle (corresponding to the compression cycle of cylinder 1) it may cause spark firing in cylinder 3 even in the absence of an ignition pulse from ignition module 14.

Figure 7:
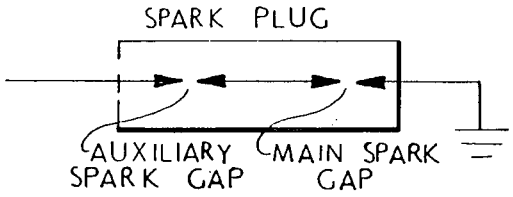
FIG. 7 is a schematic representation of a spark plug having two gaps to inhibit spark plug firing in the absence of an ignition module pulse.

One way of avoiding such undesirable spark firing is to use two supplemental spark energy modules so that an ignition coil has applied spark energy only during the compression and exhaust cycles, and no spark energy is applied during the intake and power cycles. Other ways of preventing spark ignition during the intake cycle include using a large spark gap on the spark plugs, using a spark plug with a second, auxiliary spark gap outside the combustion chamber (see FIG. 7), or using a lower output voltage from the supplemental spark energy module. All these measures reduce the likelihood of a spark occurring during an intake stroke.

Referring to FIG. 4, supplemental spark energy module 32 includes a full wave bridge rectifier circuit with diodes 81, 82, 83 and 84. The parallel combination of a resistor 85 and a capacitor 86 are coupled across the nodes between diodes 81 and 83 and diodes 82 and 84. A transformer 87 has a primary coil 88 and a secondary coil 89 which is coupled across the nodes between diodes 81 and 82 and diodes 83 and 84. Supplemental spark energy module 32 provides a dc to dc conversion so that "push-pull" switching of 12 volts applied to primary coil 88 is converted to 3000 volts at the output of module 32 across capacitor 86. Output terminals A and B are floating relative to ground so that they can apply a series voltage with respect to terminals of the secondary coil and not establish another reference potential.

Figure 5:
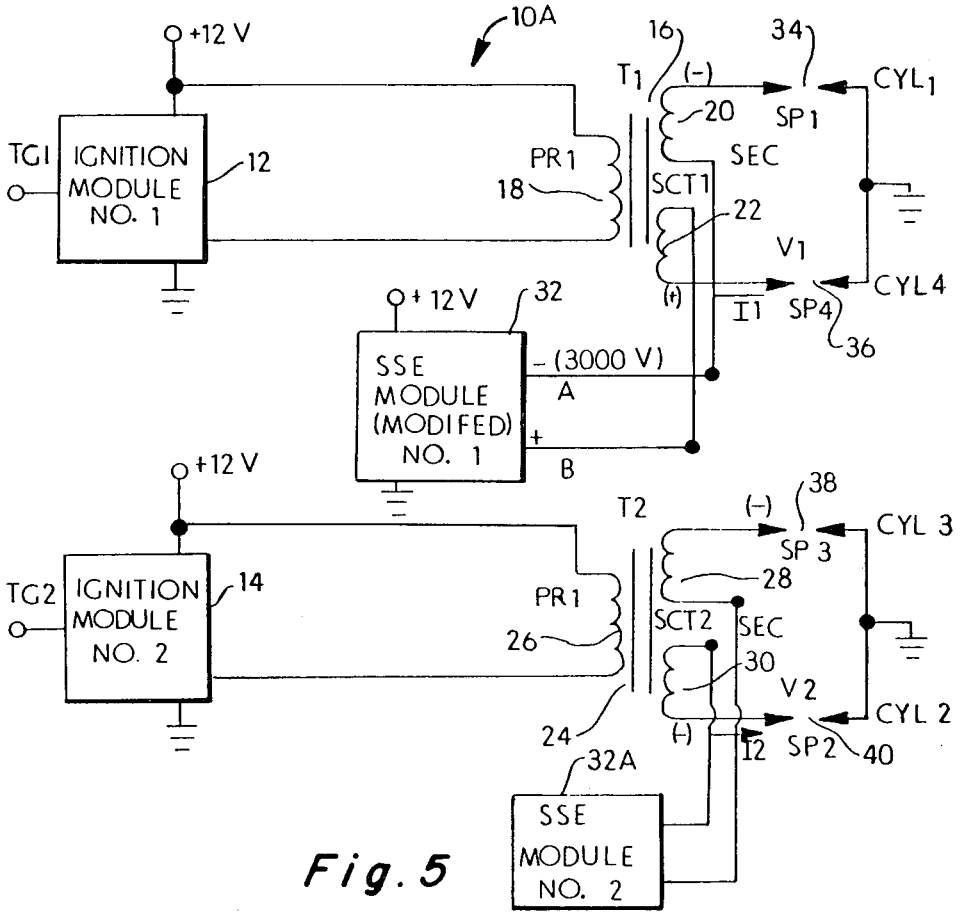
FIG. 5 is a schematic diagram of a distributorless ignition system in accordance with another embodiment of this invention including two supplementary spark energy modules, one being associated with each of two secondary windings.

Referring to FIG. 5, there is shown a schematic diagram of an ignition system 10A that is similar to ignition system 10 shown in FIG. 1. However, ignition system 10 includes a second supplemental spark energy module 32A which is coupled to ignition coil 24. Supplemental spark energy module 32 is coupled only to ignition coil 16. Using two supplemental spark energy modules is advantageous because spark energy is not applied to the cylinders during the intake stroke.

Figure 6:
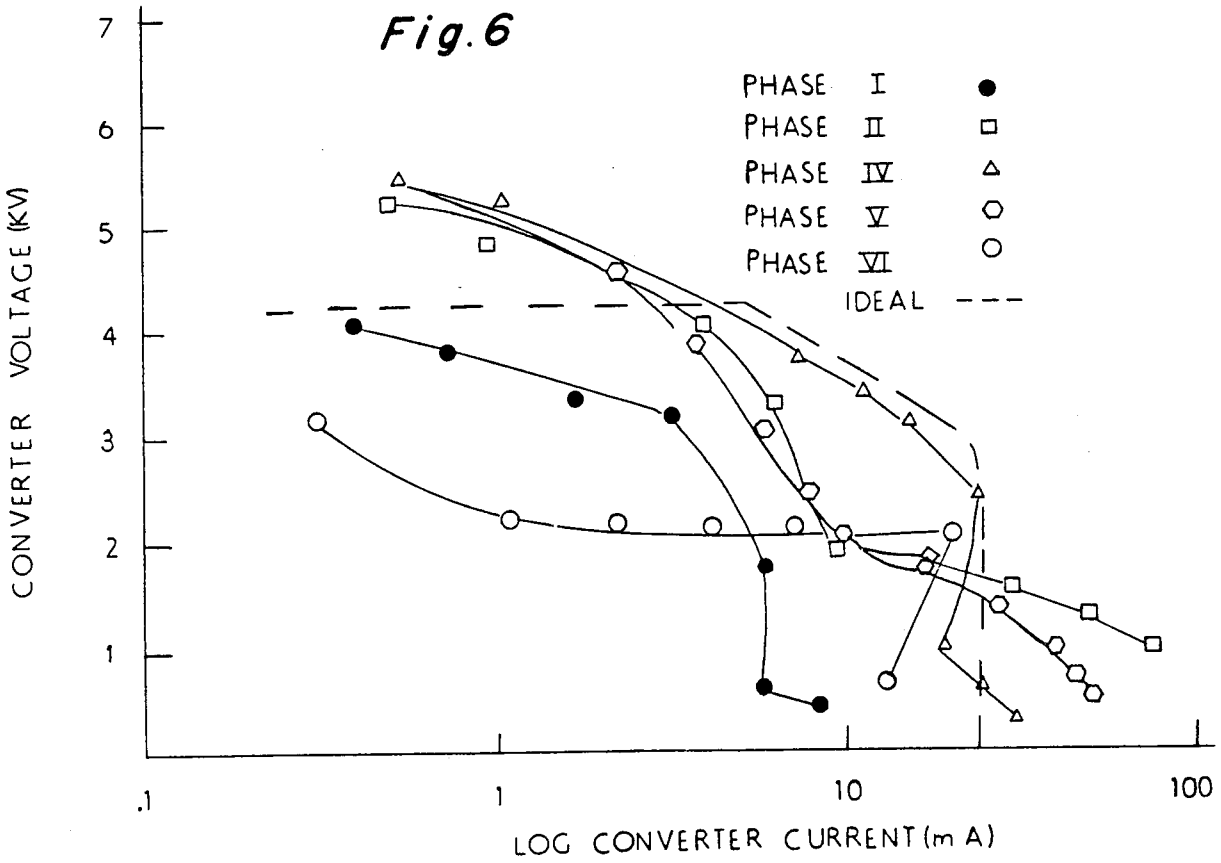
FIG. 6 is a graphical representation of static output voltage vs. output current for five different supplemental spark energy module designs.

In FIG. 6, the power supply characteristics of five SSE modules are shown, as converter output voltage vs. converter output current. The Phase I design exhibits a limited output current capability over the load range. Output levels tailed off considerably in the medium and high load regions, proving inadequate for the required application of spark sustaining in highly turbulent combustion chambers. Phases II and IV display improved characteristics and demonstrate higher output voltage and current at high loads (high currents) while still maintaining a sufficient sustaining voltage in the light load (low current) region. The Phase V design implements an externally controlled oscillator and still maintains the desired output characteristics of the Phase II series, as determined in actual engine testing. Phase VI demonstrates a design having a lower output voltage. An ideal or desired voltage versus current characteristics is shown in dashed line. Generally, an ideal current versus voltage relationship has a maximum power limitation so that above a given current there is a drop in the output voltage.

Figure 8A:
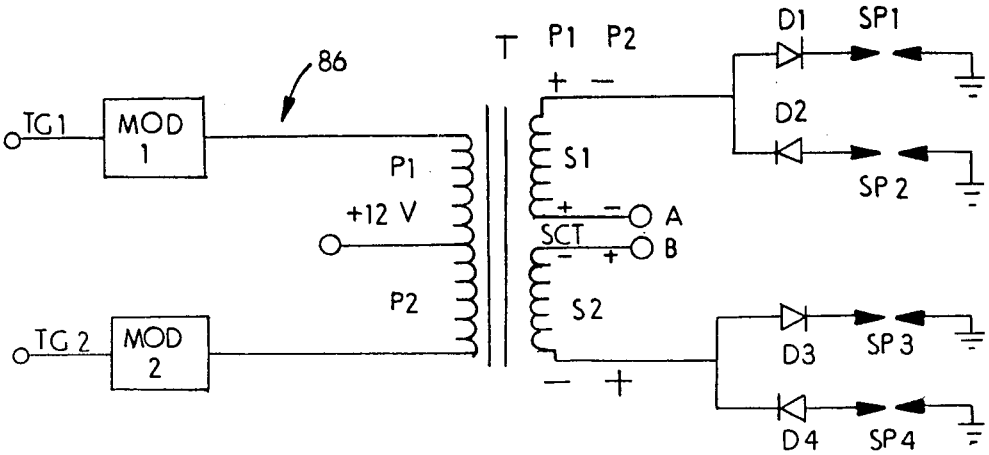
FIG. 8A is a schematic diagram of a distributorless ignition system in accordance with another embodiment of this invention.
Figure 8B:
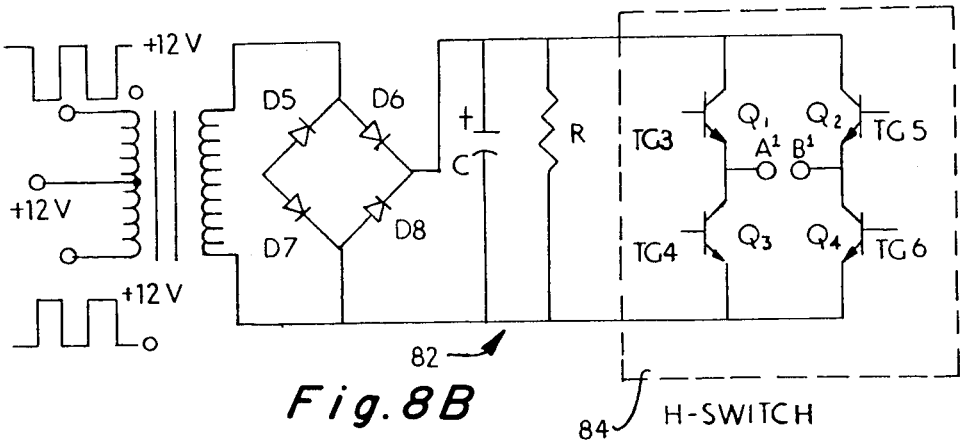
FIG. 8B is a schematic diagram of a supplementary spark energy module for use with the ignition system of FIG. 8A.
Figure 8C:
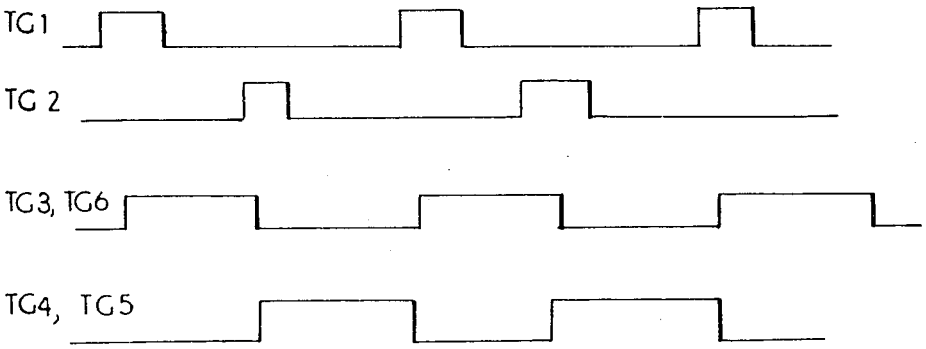
FIG. 8C is a graphical repesentation of voltage waveforms versus time at correspondingly identified locations in FIGS. 8A and 8B.

Referring to FIG. 8B, a modified SSE module 82 incorporating an "H-switch" 84 is connected to the high voltage diode DIS/SSE system 86, shown in FIG. 8A, such that terminals A and B of FIG. 8A are connected to terminals $A^1$ and $B^1$ of FIG. 8B, respectively. The H-switch 84 allows the output polarity at $A^1$ and $B^1$ to alternate depending on the states of transistors $Q_1$, $Q_2$, $Q_3$ and $Q_4$. For example, with $Q_1$, $Q_4$ on and $Q_2$, $Q_3$ off, $A^1$ is positive and $B^1$ is negative. Likewise, with $Q_2$, $Q_3$ on and $Q_1$, $Q_4$ off, opposite polarities are applied to $A^1$ and $B^1$. Thus, the polarities of $A^1$, $B^1$ can be exactly matched to that of A, B, so that series sustaining of the spark energy and duration occurs. For example, with the firing of primary coil P1 in FIG. 8A, a positive polarity may be generated at the top of secondary coils S1 and a negative polarity at the bottom of secondary coil S2. In this case, $A^1$ is made positive and $B^1$ negative, causing SSE module 82 voltage to serially add to the coil voltage of secondary coils S1 and S2 and resulting in spark enhancement at spark plugs SP1 and SP4 of FIG. 8A. Likewise, when primary coil P2 is fired, terminals A, $A^1$ are negative and B, $B^1$ positive, resulting in spark enhancement at spark plugs SP2, SP3. The state of H-switch 84 is determined by signals TG3–TG6 (FIG. 8C) which must be phase related to signals TG1, TG2 as shown. Note that H-switch 84 must be closed during the sparking period, which occurs immediately after the high to low transitions of TG1 and TG2.

Various modifications and variations will no doubt occur to those skilled in the arts to which this invention pertains. For example, the number of cylinders may be varied from that disclosed herein. These and all other modifications which basically rely on the teachings through which this disclosure has advanced the art are properly considered within the scope of this invention.

I claim:

1. A distributorless ignition system with increased spark energy including:

a first ignition coil having a first primary winding and a first secondary winding including a first split secondary center tap;

a second ignition coil having a second primary winding and a second secondary winding including a second split secondary center tap;

a first ignition module coupled to said first primary winding;

a second ignition module coupled to said second primary winding;

a first supplementary spark energy module coupled to said first split secondary tap;

a second supplementary spark energy module coupled to said second split secondary tap;

a first pair of spark plugs coupled to said first secondary winding; and a second pair of spark plugs coupled to said second secondary winding.

2. A distributorless ignition system as recited in claim 1 wherein each of said first and second supplementary spark module includes:

a diode bridge having two parallel paths each of two diodes in series;

a module coil coupled to points between the diodes in each of the parallel paths;

a resistor coupled in parallel with said two parallel paths;

a capacitor coupled in parallel to said two parallel paths; and said capacitor being coupled across one of said first split secondary center tap and said second split secondary center tap.

* * * * *